US005277110A

United States Patent [19]

Scherp

[11] Patent Number: 5,277,110

[45] Date of Patent: Jan. 11, 1994

[54] STENCIL PRINTING MACHINE

[75] Inventor: Sven Scherp, Södertälje, Sweden

[73] Assignee: Svecia Screen Printing Systems AB, Norsborg, Sweden

[21] Appl. No.: 938,059

[22] PCT Filed: Apr. 22, 1991

[86] PCT No.: PCT/SE91/00282

§ 371 Date: Oct. 20, 1992

§ 102(e) Date: Oct. 20, 1992

[87] PCT Pub. No.: WO91/16202

PCT Pub. Date: Oct. 31, 1991

[30] Foreign Application Priority Data

Apr. 25, 1990 [SE] Sweden ..... 9001485

[51] Int. Cl.[5] ..... B05C 17/04

[52] U.S. Cl. ..... 101/124; 101/126

[58] Field of Search ..... 101/114, 123, 124, 126, 101/127, 127.1, 128.1, 129

[56] References Cited

U.S. PATENT DOCUMENTS

| | | | |
|---|---|---|---|
| 3,941,053 | 3/1976 | Black et al. | 101/124 |
| 4,193,344 | 3/1980 | Ericsson | 101/126 |
| 4,589,336 | 5/1986 | Klemm | 101/123 |
| 4,802,410 | 2/1989 | Ericsson | 101/124 |
| 4,854,229 | 8/1989 | Vassiliou | 101/123 |
| 4,909,145 | 3/1990 | Ericsson | 101/123 |
| 4,998,470 | 3/1991 | Klemm | 101/124 |

*Primary Examiner*—Edgar S. Burr
*Assistant Examiner*—Ren Yan
*Attorney, Agent, or Firm*—Burns, Doane, Swecker & Mathis

[57] ABSTRACT

The invention relates to a stencil printing machine (1) having a printing table (2), a reciprocatingly movable stencil frame (4), a stencil (5) mounted in the stencil frame, a squeegee arrangement (6) which is intended, during a common movement of the stencil frame and printing table, to press print substance through a first pattern formed in the stencil and onto print material (7) located between the printing table and the stencil such as to apply a second pattern on the print material. The machine also includes a device (8) for compensating distortion of the first pattern carried by the stencil during a printing sequence. This device (8) comprises a guide rail (10), a slide (11) which can be moved along the guide rail in response to frame movement, and means (12) which coacts with the slide and which is intended to displace the stencil (5) in a direction in which distortion of the pattern as a result of cloth stretch is compensated for.

8 Claims, 1 Drawing Sheet

STENCIL PRINTING MACHINE

TECHNICAL FIELD

The present invention relates to a stencil printing machine, and then particularly to a stencil printing machine which is equipped with a printing table for supporting print-material.

The principles of the invention may be applied with stencil printing machines equipped with a fully cylindrical printing table and in which the printing table movement is effected in conjunction with a "stop cylinder function or a "swing cylinder function", although it will be understood that the invention can also be applied in machines in which the surface of the printing table is only partially cylindrical.

The invention takes as its starting point a stencil printing machine of the aforesaid kind which is provided with a reciprocatingly movable stencil frame, a stencil fitted to said frame, and a squeegee arrangement which, during movement of the stencil frame and printing table, functions to press a printing substance through a first pattern formed on the stencil, and onto print material located between the table and the stencil, such as to produce a second pattern.

The present invention also relates to the use of means for compensating for distortion of the first pattern, or stencil pattern, during a printing sequences this distortion resulting from stretching of the cloth by the squeegee arrangement as it moves across the cloth.

BACKGROUND ART

A stencil printing machine of the aforesaid kind is illustrated and described in U.K. Patent Specification No. 1,594,660, in which FIGS. 6–13 in particular illustrate a stencil printing machine of a kind with which the present invention can be said to constitute a further development.

FIG. 1 of the aforesaid-published patent specification also illustrates the discrepancy caused by a squeegee arrangement when the stencil is stretched during a printing sequence, and also illustrates how such distortion in the first or stencil pattern caused by stretching of the stencil cloth can be compensated for.

Also belonging to the present state of the art is an arrangement which is illustrated and described in U.S. Patent Specification No. 4,715,278. Among other things, this published patent specification illustrates a side view of a printing table and a stencil fitted to a stencil frame, and also illustrates schematically a discrepancy-compensating device which functions to reduce the discrepancy that would otherwise occur between the first pattern carried by the stencil and the second pattern printed on the print material should no compensation be made.

Also forming part of the present state of the art is the arrangement illustrated and described in European Patent Specification No. 0 285 587. This arrangement includes means for compensating for pattern-distortion that occurs in the stencil during a printing sequence as a result of stretching of the stencil cloth when printing in two mutually opposite directions.

SUMMARY OF THE INVENTION

Technical Problems

When considering the earlier state of the art, as described and illustrated in the aforesaid published specifications, and then in Particular in the U.K. Patent Specification No. 1,584,660, it will be seen that a technical problem resides in the provision of simple means which will enable full or partial compensation to be made for pattern distortions occurring in the stencil during a printing sequence as a result of the tensile forces (cloth stretching) which the squeegee arrangement exerts on the stencil in a stencil printing machine that includes a curved printing table.

It will also be seen that a technical problem resides in the provision of such compensating means which are not only usable with pivotal cylinder machines or stop cylinder machines, but also with stencil printing machines equipped with sector-configured printing tables.

It will also be seen that a technical problem is one of realizing the simplifications that can be expected when said compensating means includes, among other things, a guide rail and a slide which can move along said rail in response to stencil frame movement during a printing sequence, and to permit said guide rail and said slide to serve as guide means for displacing the stencil in a direction which will compensate for occurrent pattern distortion, such that the printed pattern will have a form that is almost identical to the desired pattern, thereby compensating totally or partially such pattern distortion.

It will also be seen that a technical problem resides in the provision of conditions which will make it possible to use a virtually straight guide rail but, when the need arises, to permit said rail to be slightly curved so that the guide rail will obtain a configuration and an inclination adapted to desired compensation against pattern distortion.

It will also be seen that a technical problem resides in realizing the advantages that are obtained when a guide rail is pivotally mounted at one end thereof and which can be raised and lowered at its other end with the aid of a setting screw, and also to realize that the screw setting will determine the degree of compensation for pattern distortion and, in some cases, provide a desired, insignificant overcompensation of pattern distortion.

Another technical problem is one of realizing the significance of permitting the slide to have the form of a roller which rolls along the guide rail and to realize the significance of securing said roller to one end of an angle-arm whose other end influences stencil displacement via an intermediate angle-arm pivot axle.

Another technical problem is one of realizing the significance of mounting the angle-arm pivot axle fixedly in relation to a holder or to an outer frame structure which surrounds an inner stencil frame and arranging said angle arm so that said arm will displace the inner stencil frame in said outer frame structure such as to compensate instantly any pattern distortion that occurs, in dependence on squeegee position.

In this regard, it will be seen that another technical problem resides in the significance of inclining the guide rail in the printing direction, such as to cause the stencil to be displaced in a direction opposite to said printing direction.

It will also be seen that a technical problem is one of realizing that such compensation can also be made when printing on print material of different thicknesses.

Finally, it will be seen that a further technical problem is one of realizing that a discrepency-compensating device can be adapted advantageously for use with a stencil printing machine that is equipped with a flat reciprocatingly moveable printing table.

SOLUTION

The present invention departs from a stencil printing machine of the kind that includes a curved printing table, a reciprocatingly movable stencil frame, a stencil carried in the frame, and a squeegee arrangement which during movement of the stencil frame and the printing table functions to press printing substance through a first pattern formed in the stencil and onto print material located between the printing table and the stencil such as to print a second pattern on said material with the aid of a device which functions to compensate, either completely or partially, for distortion of the first pattern on said stencil during a printing sequence as a result of stretching of the stencil.

It is proposed in accordance with the present invention that said distortion compensating device has the form of a guide rail and a slide which can be displaced along the guide rail in response to stencil frame movement; and that a means is provided for coaction with the slide such as to compensate for distortion that would otherwise occur, by displacing the stencil in a direction opposite to the printing direction.

In accordance with further developments of the invention which lie within the general concept thereof, it is proposed that the guide rail is provided with a horizontal, or substantially horizontal slide surface or rolling surface whose configuration and inclination or slope are adapted to the extent to which compensation is to be made.

In this regard, it is suggested that the guide rail is straight, or substantially straight, and is pivotally mounted at one end thereof and raisable and lowerable at the other end thereof, said other end being located adjacent the printing table.

It is also proposed that a setting screw is provided for enabling the guide rail to be inclined at an angle adapted to the desired compensation for pattern distortion.

It is also proposed that the slide has the form of a roller arranged for movement along the guide rail and mounted on one end of an angle arm, the other end of which influences stencil displacement via an intermediate angle-arm pivot axle.

It is important that the arm pivot axle is attached relative to a holder or an outer frame structure in which the stencil frame is mounted, and that the angle arm is able to displace the stencil frame slightly in said outer frame structure.

The guide rail is inclined slightly in the printing direction.

ADVANTAGES

Those advantages primarily associated with the inventive stencil printing machine reside in the provision of conditions which enable cloth-stretch induced pattern distortions in the stencil during a printing sequence to be compensated for by causing a guide rail to displace the stencil slightly in a direction opposite to the printing direction.

The primary characteristic features of the inventive stencil printing machine are set forth in the characterizing clause of the following claim 1.

BRIEF DESCRIPTION OF THE DRAWINGS

An exemplifying embodiment of the invention at present preferred and having characteristic features significant of the present invention will now be described in more detail with reference to the accompanying drawing, in which.

DESCRIPTION OF EMBODIMENTS AT PRESENT PREFERRED

Figure 1:
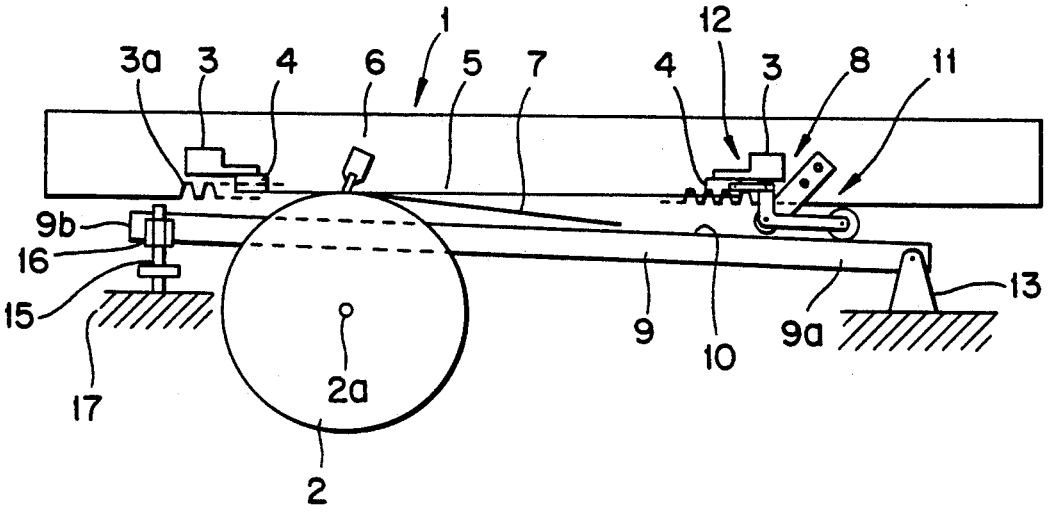
FIG. 1 is a highly simplified side view of a stencil printing machine having a cylindrical printing table and provided with a simple device for fully or partially compensating for pattern distortion occurring in the stencil during a printing sequence.
Figure 2:
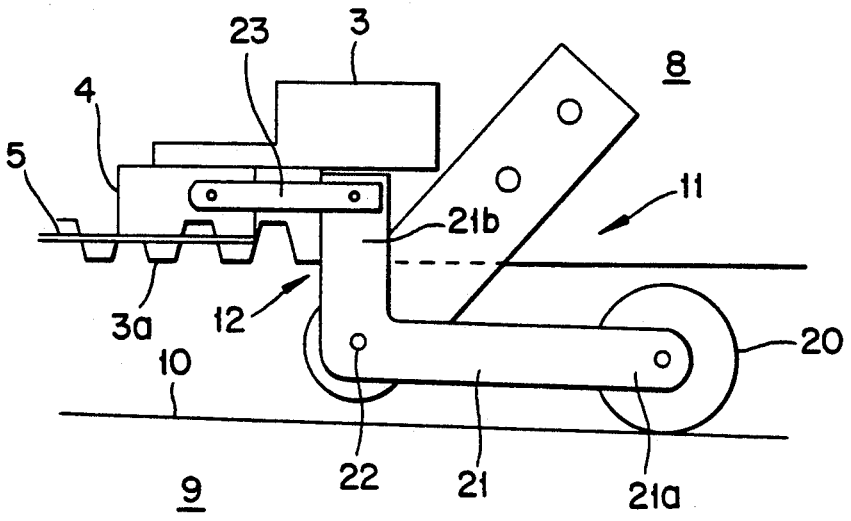
FIG. 2 illustrates the device in a slightly larger scale.

FIG. 1 is a side view, greatly simplified, of a stencil printing machine, and illustrates the inventive principles.

Since a stencil printing machine of the kind illustrated in FIG. 1 is known in principle, and since the manner in which the various machine parts are driven and coact with one another is also known to the art, no detailed description will be given in this regard.

It can be mentioned, however, that the machine 1 includes a curved printing table 2, which in the illustrated case is a cylindrical table.

The illustrated machine also includes a horizontally reciprocating outer stencil frame structure 3 in which there is mounted an inner stencil frame 4 which has a stencil 5 fitted therein.

The inner stencil frame 4 is mounted for horizontal movement in the outer frame structure 3, in a known manner.

A squeegee arrangement 6 is fixedly mounted in relation to the chassis of the machine and is intended to press printing substance through a first pattern provided in the stencil and onto print material 7 located between the printing table and the stencil such as to provide a second pattern, during movement of the stencil frame and the printing table.

The machine also includes a device 8 which is operative to compensate, either totally or partially, for distortion of the pattern in the stencil due to stretching of the stencil cloth during a printing sequence.

It should be mentioned that the side wall of the printing table 2 is normally fitted with a gear ring (not shown) which engages a rack 3*a*, thus causing the printing table 2 to be rotated about its rotational axis 2*a* in one direction and to displace the outer frame structure 3 and the stencil frame 4 horizontally in one direction.

Reciprocating rotational movement of the printing table results in horizontal reciprocating movement of the frames 3 and 4.

In accordance with the invention, the device 8 has the form of a guide rail 9 having a guide surface 10 which extends along the top of said rail, and a slide 11 which moves in response to horizontal movement of the stencil frame, said device further including means 12 which coacts with the slide and which is intended to displace the inner stencil frame 4 slightly in relation to the outer frame structure 3 and in a direction which compensates for distortion in the pattern that is otherwise likely to occur.

The guide rail 9 presents a sliding surface or rolling surface 10 whose configuration is adapted to the desired compensation for pattern distortion, implying that said surface 10 should be curved slightly.

If a straight, or substantially straight guide rail is used, it is suggested that the guide rail 9 is pivotally mounted at one end 9*a* thereof, as shown at 13, so the other end 9*b* can be raised and lowered, and is fixed in relation to the chassis.

In order to enable the guide rail 9 to be adjusted angularly so as to obtain the desired degree of compensation, there is provided a setting screw 15 which has an external screw thread.

This setting screw 15 is intended to coact with a sleeve 16 provided with a corresponding internal screw thread, so as to enable the guide rail to be inclined at an angle corresponding to the desired degree of compensation, by adjusting the distance between a fixed frame part and the slope or inclination of the guide rail 9.

The slide 11 has the form of a roller 20 which is intended to roll along the guide rail surface 10 in response to movement of the frame 3, and which is mounted on one end 21*a* of an angle arm 21, the other end 21*b* of which influences displacement of the stencil via an intermediate arm pivot axle 22.

The pivot axle 22 of the angle arm 21 is fixed in relation to a holder or frame 3 and the angle arm is intended to move the inner stencil frame 4 in said outer frame structure 3 in a horizontal direction.

When the frame structure 3 moves to the left during a printing sequence, the roller 20 will move to a higher level, since the guide rail 9 slopes upwards, and the angle arm 21 will turn anti-clockwise around the axle 22.

This rotational movement causes the end 21*b* of the arm 21 to move to the left and, via a link arm 23, to urge the outer frame structure 4 to the left in relation to the inner frame 3, therewith causing the stencil 5 to move to the left through a distance adapted to the anticipated or measured stretch in the stencil cloth.

The link arm 23 is pivotally mounted on the end 21*b* and to the stencil frame 4.

The roller 20 is located to the right of the pivot axis 22 and consequently the guide rail 9 inclines upwards in the printing direction.

It will be understood that the invention is not restricted to the aforedescribed and illustrated exemplifying embodiments thereof and that modifications can be made within the scope of the invention as defined in the following claims.

I claim:

1. A stencil printing machine (1) comprising a printing table (2), a stencil frame including an outer frame (3) and an inner frame (4) with a stencil (5) having a printing pattern mounted thereon for movement relative to the printing table (2) during printing operation, said inner frame (4) being movably mounted within said outer frame (3), a squeegee arrangement (6) disposed for squeezing a printing substance through the printing pattern onto a print material located between the printing table (2) and the stencil (5), means (8) for compensating for distortion of the printing pattern on the stencil (5), said compensating means (8) comprising a guide rail (9), a slide means (11) disposed for moving along the guide rail (9) in response to the movement of said stencil frame, said slide means (11) including means (12) for coacting with said slide means (11) to displace said inner frame (4) with the stencil (5) relative to said outer frame (3) during a printing sequence in a direction that compensates for distortion of the printing pattern on the stencil (5).

2. A machine according to claim 1, wherein said guide rail (9) has a slide or rolling surface (10) for facilitating the printing pattern distortion compensation.

3. A machine according to claim 2, wherein said guide rail (9) is a substantially straight member having two ends, one end of which is pivotally mounted and the other end of which is vertically adjustably mounted.

4. A machine according to claim 3, further comprising a setting screw (15) disposed at the adjustable end of said guide rail (9) for setting said guide rail (9) at an angle of inclination for facilitating the printing pattern distortion compensation.

5. A machine according to claim 2, wherein said guide rail (9) is a straight member and is inclined in a printing direction.

6. A machine according to claim 1, further comprising a pivot axis 22, an angle arm (21) pivotally mounted on aid pivot axis (22), said slide means (11) having a roller (20) mounted on one end of said angle arm (21) for rolling along said slide surface (10) of said guide rail (9), the other end of said angle arm (21) functions to displace said inner frame (4) with the stencil (5) during printing.

7. A machine according to claim 6, wherein said pivot axis (22) is fixed in position relative to said outer frame (3).

8. A machine according to claim 1, wherein said guide rail (9) is a straight member and is inclined in a printing direction.

* * * * *